US009574820B2

(12) United States Patent
Lee

(10) Patent No.: US 9,574,820 B2
(45) Date of Patent: Feb. 21, 2017

(54) VARIABLE SHELF APPARATUS AND REFRIGERATOR HAVING THE SAME

(71) Applicant: SAMSUNG ELECTRONICS CO., LTD., Suwon-si, Gyeonggi-do (KR)

(72) Inventor: Jae-bok Lee, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/802,145

(22) Filed: Jul. 17, 2015

(65) Prior Publication Data

US 2016/0238307 A1 Aug. 18, 2016

(30) Foreign Application Priority Data

Feb. 17, 2015 (KR) ..... 10-2015-0024503

(51) Int. Cl.

| | |
|---|---|
| ***F25D 25/02*** | (2006.01) |
| ***F25D 23/00*** | (2006.01) |
| ***A47B 45/00*** | (2006.01) |
| ***A47B 46/00*** | (2006.01) |
| ***A47B 96/02*** | (2006.01) |

(52) U.S. Cl.

CPC ..... *F25D 25/02* (2013.01); *A47B 45/00* (2013.01); *A47B 46/00* (2013.01); *A47B 96/025* (2013.01); *F25D 23/00* (2013.01); *F25D 25/024* (2013.01); *F25D 25/027* (2013.01); *F25D 2325/021* (2013.01); *F25D 2325/022* (2013.01)

(58) Field of Classification Search

CPC ..... F25D 25/00; F25D 24/02; F25D 25/024; F25D 25/027; F25D 2325/00; F25D 2325/021;F25D 23/067; F25D 25/02; A47B 96/02; A47B 96/025; A47B 96/067

See application file for complete search history.

(56) References Cited

U.S. PATENT DOCUMENTS 5,340,209 A * 8/1994 Kolbe ..... F25D 25/024 312/334.46
8,403,438 B2 * 3/2013 Park ..... F25D 25/02 108/143

(Continued)

FOREIGN PATENT DOCUMENTS

CN 103017466 A 4/2013
JP S59056684 A * 4/1984 ..... F25D 25/02

(Continued)

OTHER PUBLICATIONS

Extended European Search Report dated Jun. 21, 2016 in corresponding European Patent Application No. 15200882.7.

*Primary Examiner* — Andrew Roersma
(74) *Attorney, Agent, or Firm* — Staas & Halsey LLP

(57) ABSTRACT

A variable shelf apparatus and a refrigerator having the same are provided. The variable shelf apparatus includes: a first shelf part; a second shelf part configured to have the first shelf part slidably coupled therewith; and a support part configured to be installed in a storage room to slidably support the first shelf part and rotatably support the second shelf part, wherein the support part is configured such that a pair of rotating protrusions protruding at both sides of the second shelf part is selectively coupled and separated between an upper surface and a lower surface of the support part.

18 Claims, 16 Drawing Sheets

(56) References Cited

U.S. PATENT DOCUMENTS

| | | | | |
|---|---|---|---|---|
| 8,777,341 | B2 * | 7/2014 | Amaral | F25D 25/024 108/143 |
| 2007/0096610 | A1 * | 5/2007 | Filho | A47B 57/10 312/408 |
| 2008/0303401 | A1 * | 12/2008 | Ji | F25D 25/024 312/405.1 |
| 2010/0109498 | A1 | 5/2010 | Ramm et al. | |
| 2013/0020922 | A1 * | 1/2013 | Jang | F25D 25/024 312/408 |
| 2014/0239792 | A1 * | 8/2014 | Chellappan | F25D 23/067 312/408 |
| 2014/0375199 | A1 * | 12/2014 | Lee | F25D 25/024 312/404 |
| 2015/0153099 | A1 * | 6/2015 | Nash | F25D 25/024 312/408 |

FOREIGN PATENT DOCUMENTS

| | | | | | |
|---|---|---|---|---|---|
| JP | H07218116 | A | * | 8/1995 | F25D 25/02 |
| JP | H07332843 | A | * | 12/1995 | F25D 25/02 |
| JP | H10160335 | A | * | 6/1998 | F25D 25/02 |
| JP | 2006153394 | A | * | 6/2006 | F25D 25/02 |
| KR | 100756887 | B1 | * | 9/2007 | F25D 25/02 |
| TR | 1999 00042 | A2 | | 8/2000 | |
| WO | WO2014082858 | A1 | * | 6/2014 | F25D 25/02 |

* cited by examiner

VARIABLE SHELF APPARATUS AND REFRIGERATOR HAVING THE SAME

CROSS-REFERENCE TO RELATED APPLICATIONS

This application claims priority from Korean Patent Application No. 10-2015-0024503, filed on Feb. 17, 2015, in the Korean Intellectual Property Office, the disclosure of which is incorporated herein by reference in its entirety.

BACKGROUND

1. Field

Apparatuses and methods consistent with the present disclosure relate to a variable shelf apparatus capable of partitioning an internal space of a storage room up and down and a refrigerator having the same, and more particularly, to a variable shelf apparatus capable of being selectively coupled and separated in a storage room and a refrigerator having the same.

2. Description of the Related Art

A refrigerator is configured to include a main body provided with a storage room in which foods are stored and a door opening and closing the storage room, in which the storage room is provided with a plurality of shelves which partition an internal space of the storage room up and down, i.e., in a vertical axis, to be able to efficiently store a plurality of stored goods.

Among these shelves used in the refrigerator these days, a variable shelf for storing stored goods at a relatively higher height than an interval between the shelves is present. The variable shelf partitions a rear area of the storage room up and down and includes a first shelf part and a second shelf part with which the first shelf part is slidably coupled.

Therefore, when storing stored goods having a height that is relatively lower than the interval between the shelves, the first shelf part is disposed in front of the second shelf part to partition both of a rear space of the storage room and a front space of the storage room in a vertical direction using the first shelf part and the second shelf part. Meanwhile, when storing stored goods having a height that is greater than the interval between the shelves, the first shelf part is slid back to overlap the second shelf part and then the second shelf part rotates up based on a rear end of the second shelf part together with the first shelf part, such that the stored goods at the greater or higher height may be stored in the storage room.

However, to rotate the conventional variable shelf up, a pair of rotating protrusions formed on an upper surface of the second shelf are seated in a pair of rotating protrusion seating parts formed on an upper surface of the support part, while being exposed. In this case, a member for preventing the pair of rotating protrusions of the second shelf from being separated upward with respect to the support part is not provided separately. Therefore, when a force is applied upward on the variable shelf at the time of withdrawing items placed under the variable shelf from the storage room to the outside, the variable shelf may be easily separated from the support part while being lifted up by the withdrawn items.

Meanwhile, the pair of rotating protrusions and each of the pair of rotating protrusion seating parts are formed on the upper surface of the second shelf and the upper surface of the support part and therefore the second shelf part rotating up based on the pair of rotating protrusions together with the first shelf part is supported by the rear end of the support part, such that the upper surface of the second shelf part may not face a rear wall of the storage room. Therefore, a rear end of the rotating second shelf part is supported by a separate member provided in the front thereof while the second shelf part is spaced apart from the rear end of the support part at a predetermined distance and therefore the rotating second shelf part has a non-available space commensurate with the spaced distance. In this case, when the pair of rotating protrusion seating parts is disposed at the rear of the support part to reduce the non-available space by reducing the spaced distance, a load is concentrated on the pair of rotating protrusions and the pair of rotating protrusion seating parts, thereby shortening a product life cycle.

SUMMARY

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a variable shelf apparatus in which a pair of rotating protrusions protruding from both sides of a second shelf part is selectively coupled and separated between an upper surface and a lower surface of a support part and a refrigerator having the same.

According to an aspect of the present disclosure, a variable shelf apparatus includes: a first shelf part; a second shelf part configured to have the first shelf part slidably coupled therewith; and a support part configured to slidably support the first shelf part and rotatably support the second shelf part, wherein the support part is configured such that a pair of rotating protrusions protruding at both sides of the second shelf part is selectively coupled and separated between an upper surface and a lower surface of the support part.

The support part may include: a pair of rotating protrusion receiving grooves configured to be coupled with the pair of rotating protrusions; a pair of rotating protrusion guide grooves configured to guide the pair of rotating protrusions to the pair of rotating protrusion receiving grooves along a side from the lower surface of the support part; and a pair of anti-separation parts configured to be elastically disposed on the pair of rotating protrusion guide grooves so that the pair of rotating protrusions is coupled with and separated from the pair of rotating protrusion receiving grooves.

The pair of rotating protrusion guide grooves may include: a first guide section configured to extend toward the upper surface of the support part from the lower surface of the support part; and a second guide section configured to connect one end of the first guide section to one side of the rotating protrusion receiving groove.

The second guide section may be formed in parallel with the upper surface of the support part.

The pair of anti-separation parts may be formed to have at least three surfaces cut on the pair of rotating protrusion guide grooves so as to have an elastic force in inside and outside directions of the support part.

The pair of anti-separation parts may include: an extension configured to extend along the second guide section from the one end of the first guide section; and a protrusion configured to protrude toward an inside of the support part at one end of the extension.

The protrusion may be provided with an inclined surface gradually inclined inward in a direction of the rotating protrusion receiving groove from the second guide section.

The pair of anti-separation parts may further include a releasing part which extends to an outside of the support part from one end of the protrusion to separate the rotating protrusion from the rotating protrusion receiving groove.

The support part may include: a first shelf receiving part configured to receive the first shelf part; a second shelf receiving part configured to be extendedly formed in the first shelf receiving part and receive the second shelf part; and a guide part configured to be formed along an inside of the first shelf receiving part to guide the first shelf part to the second shelf receiving part.

The guide part may include an upper guide part and a lower guide part which support an upper end and a lower end of the first shelf part.

The upper guide part and the lower guide part each include inclined surfaces so that a first shelf surface and a second shelf surface are disposed on the same plane in a state in which the first shelf part is drawn forward from the second shelf part.

The upper guide part includes an anti-sliding protrusion formed at a front end of the upper guide part so that the first shelf part is seated with the upper guide part to prevent the first shelf part from being slid forward and backward.

An outside of the first shelf part may be provided with a guide rib extending forward and backward so that the first shelf part is guided while being supported by the upper guide part.

The guide rib may include a protrusion receiving groove receiving the anti-sliding protrusion.

The lower guide part may further protrude toward the inside of the support part than the guide part and a rear end of the first shelf part may further include a height adjustment protrusion protruding downward to adjust a height of the rear end of the first shelf part while the height adjustment protrusion interfering with a rear end of the lower guide part.

A front surface of the height adjustment protrusion may be inclined.

The second shelf part may be provided with a sliding groove extending forward and backward to guide the first shelf part to the first shelf receiving part so as to support the first shelf part.

The support part may further include a seating part in which a front end of the second shelf part is seated.

According to another aspect of the present disclosure, a refrigerator includes: a storage room of which the front surface is open; an opening and closing door configured to open and close the storage room; a main body configured to include an inner case forming the storage room and an outer case forming an appearance; and a variable shelf apparatus configured to include a first shelf part, a second shelf part configured to have the first shelf part slidably coupled therewith, and a support part configured to be installed in a storage room to slidably support the first shelf part and rotatably support the second shelf part, wherein the support part includes: a pair of rotating protrusion receiving grooves configured to be coupled with the pair of rotating protrusions, a pair of rotating protrusion guide grooves configured to guide the pair of rotating protrusions to the pair of rotating protrusion receiving grooves along a side from the lower surface of the support part, and a pair of anti-separation parts configured to be elastically disposed on the pair of rotating protrusion guide grooves so that the pair of rotating protrusions is selectively coupled with and separated from the pair of rotating protrusion receiving grooves.

The pair of rotating protrusion guide grooves may include: a first guide section configured to extend toward the upper surface of the support part from the lower surface of the support part; and a second guide section configured to be formed in parallel with an upper surface of the support part to connect one end of the first guide section to one side of the rotating protrusion receiving groove.

According to an aspect of the present disclosure, a variable shelf apparatus is configured to be installed within a storage room of a refrigerator. The variable shelf apparatus may include a first shelf part, a second shelf part configured to slidably couple with the first shelf part and comprising a pair of rotating protrusions protruding at both sides of the second shelf part, and a support part configured to be installed in the storage room to slidably support the first shelf part and rotatably support the second shelf part, wherein the support part is configured such that the pair of rotating protrusions is selectively coupled and separated between an upper surface and a lower surface of the support part.

According to an aspect of the present disclosure, a variable shelf apparatus is configured to be installed within a refrigerator. The variable shelf apparatus may include a first shelf part, a second shelf part configured to slidably couple with the first shelf part and comprising a pair of rotating protrusions protruding at both sides of the second shelf part, and a support part to slidably support the first shelf part and rotatably support the second shelf part, wherein the support part is configured to be selectively coupled with and separated from the pair of rotating protrusions.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION

Hereinafter, a variable shelf apparatus and a refrigerator having the same according to an exemplary embodiment of the present disclosure will be described in detail with reference to the accompanying drawings.

Figure 1:
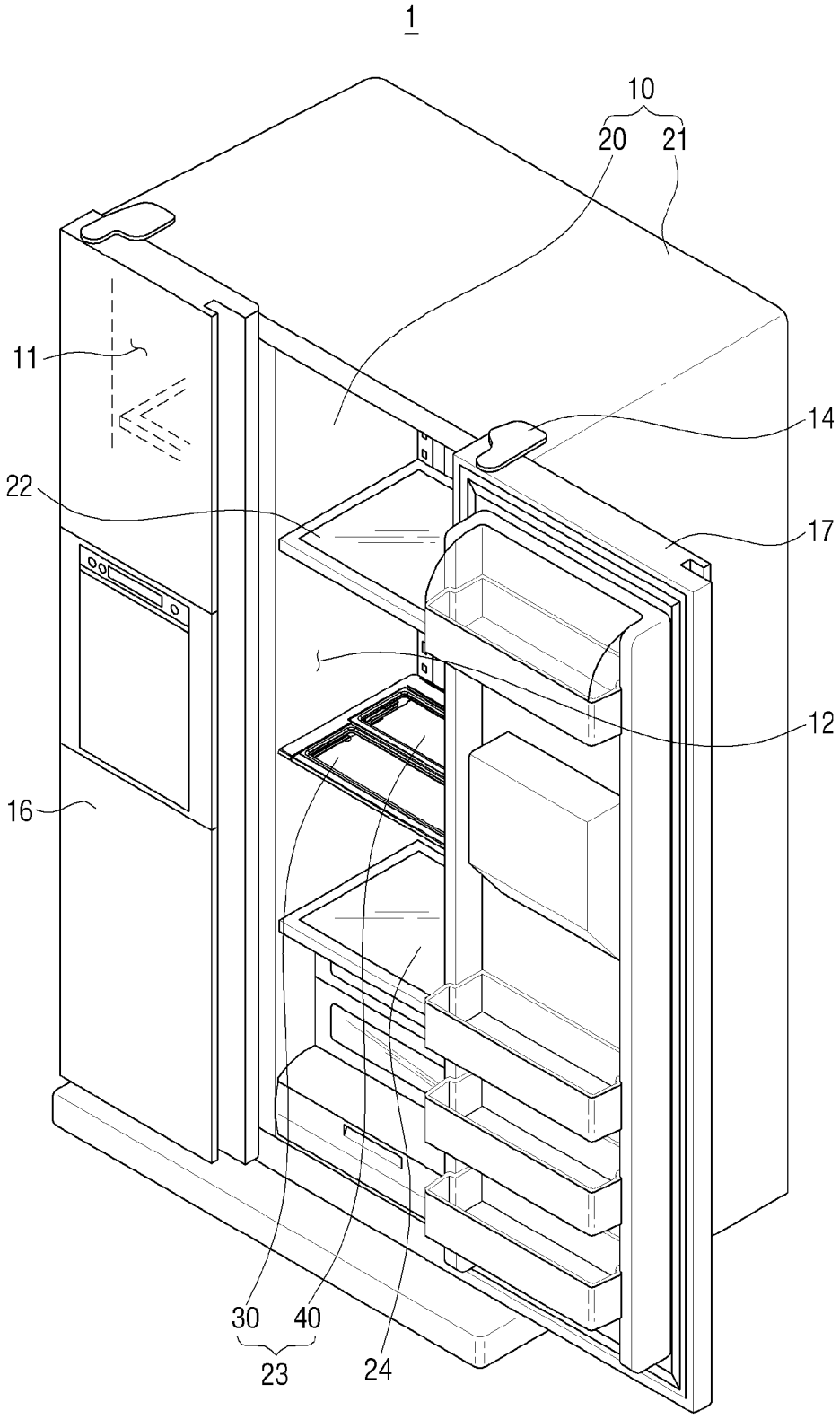
FIG. 1 is a perspective view illustrating a refrigerator according to an exemplary embodiment of the present disclosure.

FIG. 1 is a perspective view illustrating a refrigerator 1 according to an exemplary embodiment of the present disclosure.

A main body 10 is configured to include an inner case 20 forming a plurality of storage rooms and an outer case 21 forming an appearance, in which a foam insulation material (not illustrated) for insulation is foamed between the inner case 20 and the outer case 21.

The storage room may be partitioned into a freezer compartment 11 and a refrigerator compartment 12. The freezer compartment 11 and the refrigerator compartment 12 are each installed so that front surfaces thereof may be opened. Meanwhile, in the main body 10, a freezer compartment door 16 and a refrigerator compartment door 17 each may be hinge-coupled with each other by a hinge such as hinge 14 to open and close the opened front surfaces. Therefore, the freezer compartment door 16 and the refrigerator compartment door 17 may each rotate forward to open and close the opened front surfaces of the freezer compartment 11 and the refrigerator compartment 12, respectively.

The freezer compartment door 16 may be provided with a dispenser part (not illustrated) through which water or ice may be taken out from the outside without opening the freezer compartment door 16 and the freezer compartment door 16 may be provided with a home bar (not illustrated) in which small-sized food may be separately cold-stored.

Meanwhile, the refrigerator compartment is provided with shelves 22 and 24 and a variable shelf apparatus 23 on which various kinds of foods may be put. The shelves 22 and 24 and the variable shelf apparatus 23 may also be installed in the freezer compartment 11. The exemplary embodiment of the present disclosure describes an example in which, for convenience of explanation, the shelves 22 and 24 and the variable shelf apparatus 23 are installed in the refrigerator compartment 12.

Figure 14A:
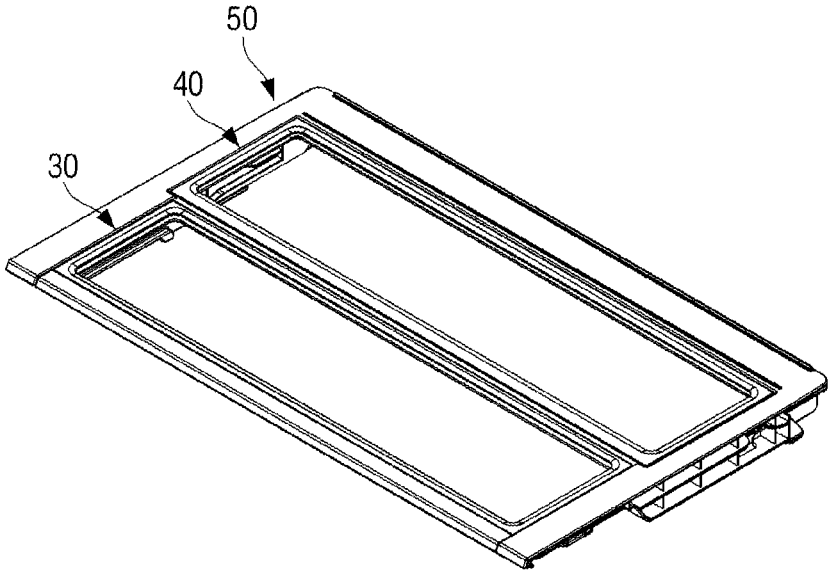
FIGS. 14A, 14B, and 14C are perspective views illustrating an operation of a variable shelf apparatus according to an exemplary embodiment of the present disclosure.

The variable shelf apparatus 23, which may be installed in the refrigerator compartment 12, partitions the refrigerator compartment 12 up and down at ordinary times and may have food or food items put thereon (see FIG. 14A). Further, when bulky foods or a tall container is disposed in the shelf 24 disposed under the variable shelf apparatus 23, the variable shelf apparatus 23 may vary in a folded state without interfering with the foods or the upper portion of a container to secure a storage space.

The variable shelf apparatus 23 may be configured to include a first shelf part 30 disposed in the front of the refrigerator compartment 12 and a second shelf part 40 disposed behind the first shelf part 30, that is toward the rear of the refrigerator compartment 12.

Figure 14B:
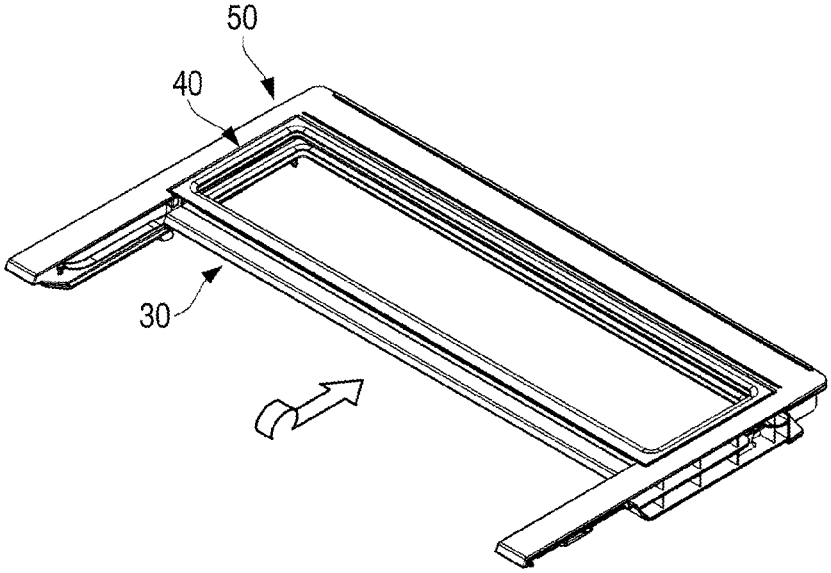

The first shelf part 30 may be slid toward the rear of the refrigerator compartment 12 and thus may be disposed to overlap a lower portion of the second shelf part 40 (see FIGS. 14A and 14B, for example).

Figure 14C:
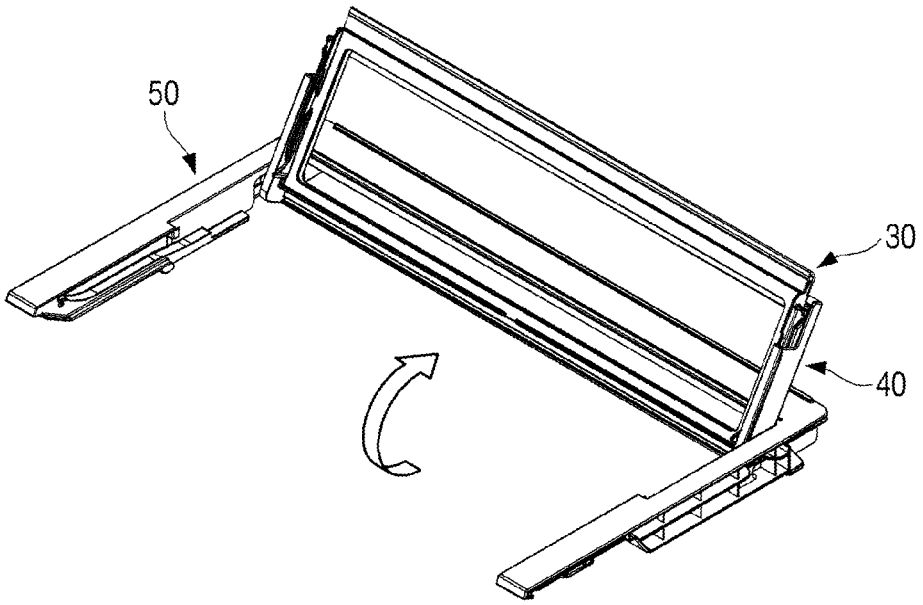

The second shelf part 40 may rotate upward based on a pair of rotating protrusions together with the first shelf part 30 when the first shelf part 30 overlaps the lower portion of the second shelf part 40 (see FIG. 14C, for example).

By the structure illustrated in FIGS. 14A-14C, the first shelf part 30 and the second shelf part 40 may be folded and then may rotate toward a rear wall of the refrigerator compartment 12, such that the refrigerator compartment 12 may have additional space in which bulky foods or a tall container may be stored. Hereinafter, a structure of the variable shelf apparatus 23 and the support part 50 according to an exemplary embodiment of the present disclosure will be described.

Figure 2:
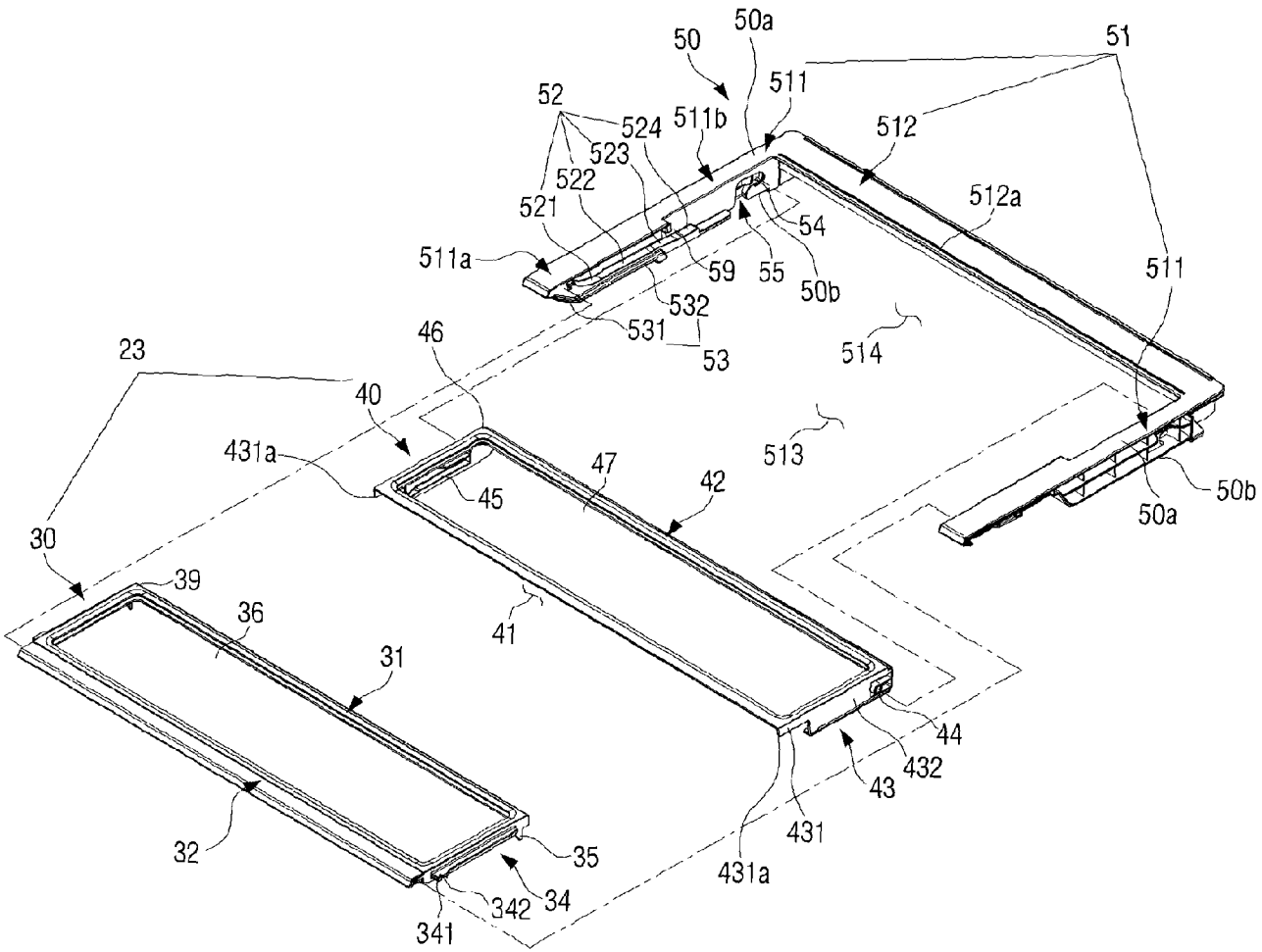
FIG. 2 is an exploded perspective view illustrating a variable shelf apparatus and a support part of the refrigerator according to an exemplary embodiment of the present disclosure.
Figure 3:
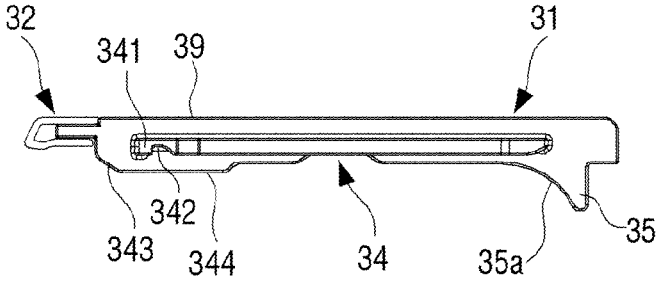
FIG. 3 is a side view illustrating a first shelf part illustrated in FIG. 2.
Figure 4:
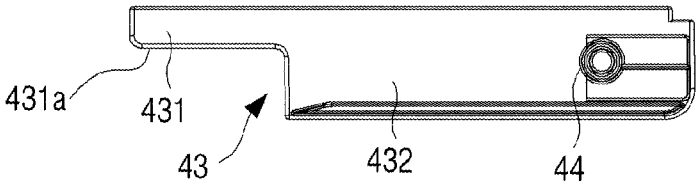
FIG. 4 is a side view illustrating a second shelf part illustrated in FIG. 2.

FIG. 2 is an exploded perspective view illustrating the variable shelf apparatus 23 and the support part 50 of the refrigerator according to an exemplary embodiment of the present disclosure, FIG. 3 is a side view illustrating the first shelf part 30 illustrated in FIG. 2, and FIG. 4 is a side view illustrating the second shelf part 40 illustrated in FIG. 2.

Referring first to FIG. 2, the variable shelf apparatus 23 may be configured to include the slidable first shelf part 30 and the rotatable second shelf part 40.

The first shelf part 30 may be configured to include first tempered glass 36 which has an approximately rectangular shape on which foods may be placed, a first shelf body 31 enclosing the first tempered glass 36, and a front frame 32 coupled with a front end of the first shelf body 31.

The first tempered glass 36 is made of a visible transparent material, and as a result, things may be put on an upper surface of the first tempered glass 36 and things put on the shelf 24 disposed under the first tempered glass 36 may be viewed and thus confirmed with the naked eye, such that an aesthetic sense may be enhanced and the refrigerator compartment 12 may look bigger.

The first shelf body 31 may be configured of a frame on which the foregoing first tempered glass 36 may be installed and an upper surface of the first shelf body 31 may be provided with a first shelf surface 39.

Referring to FIGS. 2 and 3, the first shelf body 31 may be guided while a lower end of the first shelf body 31 is supported by a lower guide part 53 of the support part 50 as described below. In detail, the lower end of the first shelf body 31 may include a first lower end surface 343 which is guided while being supported by a first lower guide part 531 of the lower guide part 53 and a second lower end surface 344 guided forward and backward while being supported by the second lower guide part 532 of the lower guide part 53. Here, the first lower guide part 531 may be formed to be inclined upward in a forward direction.

Further, an outside of the first shelf body 31 may be provided with a guide rib 34 which extends forward and backward so that an upper end of the first shelf body 31 may be guided while being supported by an upper guide part 52 of the support part 50, as described in more detail below.

The guide rib 34 may be provided with a protrusion receiving groove part 341 in which one end of the upper guide part 52 is provided with a protrusion receiving groove 342 for receiving an anti-sliding protrusion 56 which protrudes upward. As a result, the first shelf part 30 may be prevented from being separated forward with respect to the support part 50 through the protrusion receiving groove 342 in which the anti-sliding protrusion 56 is received. Further, for the first shelf part 30 to be slid downward with respect to the second shelf part 40, the receiving of the anti-sliding protrusion 56 is released from the protrusion receiving groove 342 by an operation of lifting up a front end of the first shelf part 30.

A rear end of the first shelf body 31 is provided with a height adjustment protrusion 35 protruding downward to adjust a height of a rear end of the first shelf part 30 while the height adjustment protrusion 35 interferes with a rear end of the lower guide part 53.

In detail, the height adjustment protrusion 35 has an inclined front surface 35*a* and thus when the first shelf part 30 moves forward, the height adjustment protrusion 35 moves the rear end of the first shelf body 31 upward while interfering with the rear end of the lower guide part 53 to adjust the height of the rear end of the first shelf body 31. In this case, the front surface 35*a* of the height adjustment protrusion 35 may be curved inward to reduce an impact with the rear end of the lower guide part 53 and adjust the height with a smooth operation.

The front frame 32 is inclined downward in a forward direction and thus when the first shelf part 30 is drawn from the second shelf part 40, front frame 32 may be seated at one end of the first lower guide part 531.

Referring back to FIG. 2, the second shelf part 40 is disposed at the rear of the first shelf part 30 and like the first shelf part 30, the second shelf part 40 may be configured to include second tempered glass 47 which has an approximately rectangular shape on which foods or food items may be placed, a second shelf body 42 enclosing the second tempered glass 47, and skirt parts 43 coupled with both sides of the second shelf body 42. Further, the second shelf part 40 has a horizontal width larger than that of the first shelf part 30 so that the lower portion of the second shelf part 40 may receive the first shelf part 30.

The second shelf body 42 may be configured of a frame on which the foregoing second tempered glass 47 may be installed and an upper surface of the second shelf body 42 may be provided with a second shelf surface 46, like the first shelf body 31.

Referring to FIG. 4, the skirt part 43 includes a first skirt part 431 which extends downward from the second shelf surface 46 and is disposed at a front end of the second shelf part 40 to get a lower end of the skirt part 43 to be stepped and a second skirt part 432 which is disposed at a rear end of the second shelf part 40 and further extends downward than the first skirt.

A front end 431*a* of the first skirt part 431 may be seated in a seating part 59 of the support part 50 to be described below.

An inside of the second skirt part 432 may be provided with a sliding groove 45 which extends forward and backward to guide the first shelf part 30 to the lower portion of the second shelf part 40 so as to support the first shelf part 30. In detail, the sliding groove 45 is connected to a rear end of the upper guide part 52 of the support part 50 to guide the guide rib 34 of the first shelf part 30. Further, a front end of the sliding groove 45 may be inclined downward so that the guide rib 34 of the first shelf part 30 is smoothly guided from the upper guide part 52 of the support part 50.

Further, the second skirt part 432 includes a pair of rotating protrusions 44 which protrude outward. The pair of rotating protrusions 44 may be selectively coupled with and separated from a pair of rotating protrusion receiving grooves 54 which are formed between an upper surface 50*a* and a lower surface 50*b* of the support part 50 to be described below.

Figure 5:
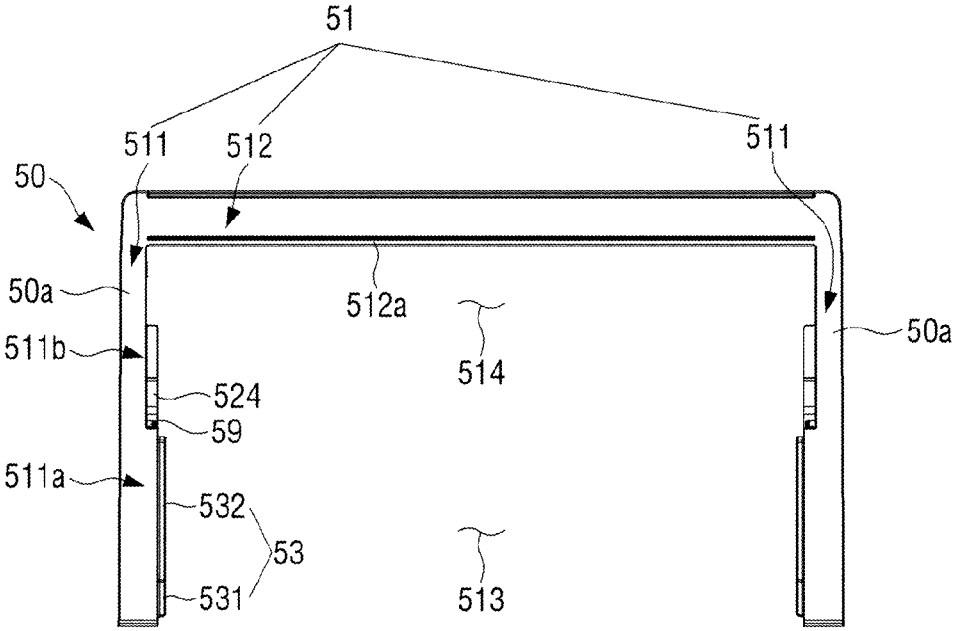
FIG. 5 is a plan view illustrating the support part illustrated in FIG. 2.
Figure 6:
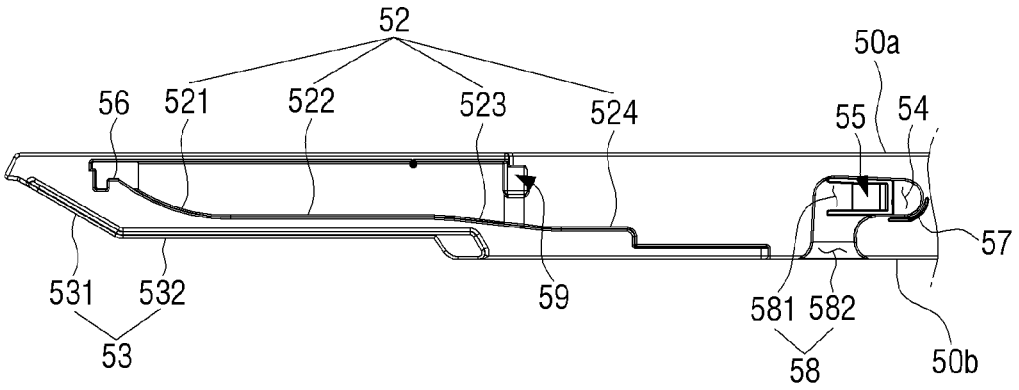
FIG. 6 is a side view illustrating an inside of a side support frame illustrated in FIG. 2.
Figure 7:
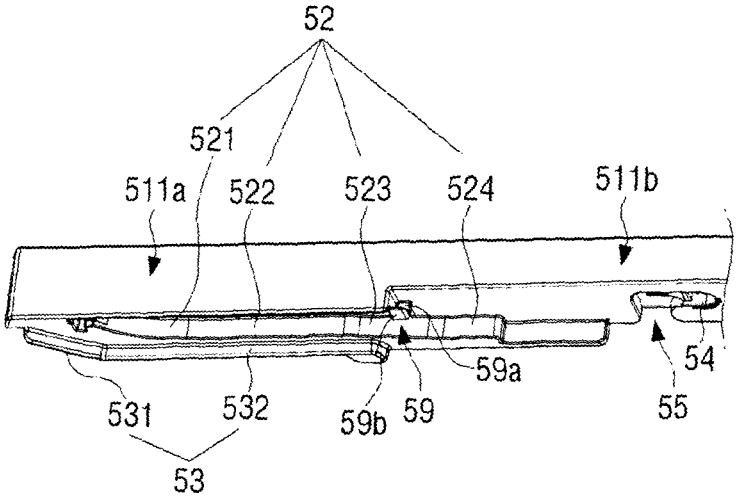
FIG. 7 is a perspective view illustrating the inside of the side support frame illustrated in FIG. 2.

FIG. 5 is a plan view illustrating the support part 50 illustrated in FIG. 2, FIG. 6 is an inside view illustrating an inside of a side support frame 511 illustrated in FIG. 2, and FIG. 7 is a perspective view illustrating the inside of the side support frame 511 illustrated in FIG. 2.

Referring to FIGS. 5 to 7, the support part 50 may be configured of a support frame which includes a pair of side support frames 511 and a single rear support frame 512 and includes the upper surface 50*a* and the lower surface 50*b*.

The pair of side support frames 511 may be configured to include a pair of first side support frames 511*a* and a pair of second side support frames 511*b* each of which are connected to rear ends of the pair of first side support frames 511*a*.

The pair of first side support frames 511*a* may form a first shelf receiving part 513 in which the first shelf part 30 is received and the pair of second side support frames 511*b* may form a second shelf receiving part 514 which is disposed at a rear of the first shelf receiving part 513 and receives the second shelf part 40. In detail, the pair of first side support frames 511*a* may partition a space by insides thereof to form the first shelf receiving part 513. Similarly, the pair of second side support frames 511*b* may partition a space by insides thereof to form the second shelf receiving part 514. Further, the pair of second side support frames 511*b* may be formed to have a distance between the insides larger than that between the insides of the pair of first side support frames 511*a* to form the second shelf receiving part 514 which receives the second shelf part 40 having a horizontal width larger than that of the first shelf part 30.

The rear support frame 512 may be formed to connect between the respective rear ends of the pair of side support frames 511. Meanwhile, the rear support frame 512 may be integrally formed with the pair of side support frames 511.

Referring back to FIGS. 6 and 7, the guide parts 52 and 53 may be formed along the inside of the first shelf receiving part 513 so that the support part 50 guides the received first shelf part 30 from the first shelf receiving part 513 to the second shelf receiving part 514. In detail, the guide part may include the upper guide part 52 and the lower guide part 53 which support an upper end and a lower end of the first shelf part 30.

The upper guide part 52 may be configured to include a first upper guide part 521 formed to be inclined upward in a forward direction, second and fourth upper guide parts 522 and 524 formed to be approximately horizontal to the upper surface 50*a* and the lower surface 50*b* of the support part 50, and a third upper guide part 523 formed to connect between the second and fourth upper guide parts 522 and 524 and be inclined upward in a forward direction. The guide rib 34 may be smoothly guided by the upper guide part 52 of which the height sequentially varies. One end of the front of the first upper guide part 521 may be provided with the anti-sliding protrusion 56 protruding upward to prevent the sliding of the first shelf part 30.

The upper guide part 52 may be formed at the inside of the support part 50, in detail, at the inside of the first side support frame 511*a* as a long groove which extends forward and backward and may extend up to a portion of the inside of the second side support frame 511*b*.

The lower guide part 53 is formed at a position lower than the upper guide part 52 and may be configured to include a first lower guide part 531 formed at the front end of the lower guide part 53 to be inclined upward in a forward direction and the second lower guide part 532 formed to be approximately horizontal to the upper surface 50*a* and the lower surface 50*b* of the support part 50. The lower guide part 53 may be configured of a protrusion extending forward and backward on the inside of the support part 50, in detail, on the inside of the first side support frame 511. However, the protrusion does not extend up to the inside of the second side support frame 511.

Therefore, when the first shelf part 30 is slid forward while being drawn from the lower portion of the second shelf part 40, the upper guide part 52 may guide the guide rib 34 protruding from the outside of the first shelf part 30 and the lower guide part 53 may guide a lower end surface of the first shelf part 30. Further, the upper guide part 52 and the lower guide part 53 each include the first upper guide part 521 and the first lower guide part 531, which are inclined upward and therefore the first shelf part 30 is slid forward in the state in which the first shelf part 30 is drawn forward from the second shelf part 40, the first shelf part 30 moves upward by the first upper guide part 521 and the first lower guide part 531, such that the first shelf surface 39 and the second shelf surface 46 may be disposed on the same plane.

Further, the support part 50 may include the seating part 59 formed to be adjacent to the rear end of the first side support frame 511*a* so that the front end 431*a* of the first skirt part of the second shelf part 40 may be seated. Referring to FIG. 7, the seating part 59 has the outside and the upper surface 50*a* approximately opened and is formed to have a bottom part 59*a* and an inside part 59*b*, such that the front end 431*a* of the first skirt part of the first shelf part 30 may be seated and supported in the seating part 59.

Figure 8:
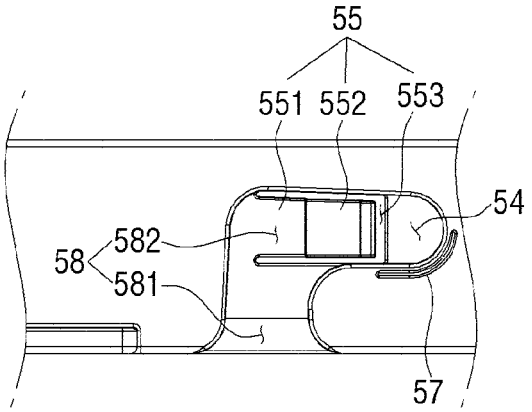
FIG. 8 is a partial side view illustrating a rotating protrusion receiving groove, a rotating protrusion guide groove, and an anti-separation part of the support part illustrated in FIG. 2.
Figure 9:
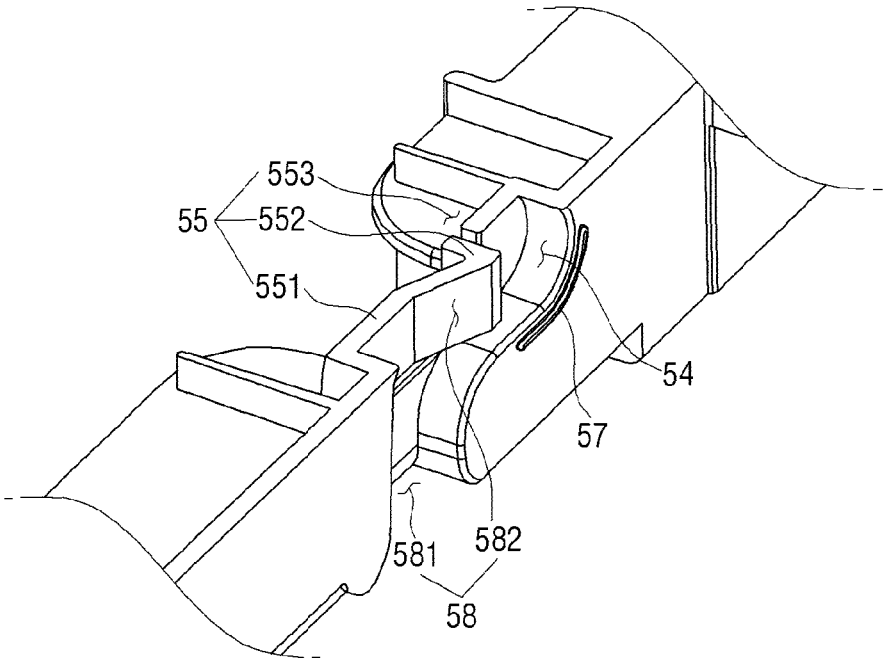
FIG. 9 is a partial cut-away view illustrating the rotating protrusion receiving groove, the rotating protrusion guide groove, and the anti-separation part of the support part illustrated in FIG. 8.

FIG. 8 is an inside view illustrating the rotating protrusion receiving groove 54, a rotating protrusion guide groove 58, and an anti-separation part 55 of the support part 50 illustrated in FIG. 2 and FIG. 9 is a partial cut-away view illustrating the rotating protrusion receiving groove 54, the rotating protrusion guide groove 58, and the anti-separation part 55 illustrated in FIG. 8.

Referring to FIGS. 8 and 9, the support part 50 is configured to include the pair of rotating protrusion receiving grooves 54 with which the pair of rotating protrusions 44 is coupled, the pair of rotating protrusion guide grooves 58 guiding the pair of rotating protrusions 44 to the rotating protrusion receiving grooves 54 along a side from the lower surface 50*b* of the support part 50, and a pair of anti-separation parts 55 elastically disposed on the pair of rotating protrusion guide grooves so that the pair of rotating protrusions 44 may be selectively coupled with and separated from the pair of rotating protrusion receiving grooves 54.

The pair of rotating protrusion receiving grooves 54 is formed between the upper surface 50*a* and the lower surface 50*b* of the support part 50 so that the pair of rotating protrusions 44 protruding at both sides of the second shelf part 40 may be selectively coupled and separated between the upper surface 50*a* and the lower surface 50*b* of the support part 50. Therefore, the pair of rotating protrusion receiving grooves 54 may prevent the pair of rotating protrusions 44 of the second shelf from being separated upward with respect to the support part 50 and even when a user applies force upward with respect to the variable shelf apparatus 23 to withdraw things put under the variable shelf apparatus 23 to the outside, the variable shelf apparatus 23 is prevented from being separated upward from the upper surface 50*a* of the support part 50.

The pair of rotating protrusion guide grooves 54 may be configured to include a first guide section 581 which extends toward the upper surface 50*a* of the support part 50 from the lower surface 50*b* of the support part 50 and a second guide section 582 connecting one end of the first guide section 581 to one side of the rotating protrusion receiving groove 54. The second guide section 582 is formed to be inclined downward in a forward direction and thus may be formed to be in parallel with the upper surface 50*a* of the support part 50 or to be inclined downward in a backward direction to prevent a phenomenon in which a load of the first and second shelf parts 30 and 40 is concentrated on the pair of anti-separation parts 55. Therefore, as a considerable amount of load of the first and second shelf parts 30 and 40 reaches the pair of anti-separation parts 55, an operation of releasing the pair of anti-separation parts 55 may be made smoothly.

The pair of anti-separation parts 55 includes a cut-away groove 553 which is disposed on the rotating protrusion guide grooves 58 and is formed to have at least three surfaces cut on the pair of rotating protrusion receiving grooves 54 so as to have an elastic force in both inside and outside directions of the support part 50. In detail, the pair of anti-separation parts 55 may be configured to include an extension 551 which extends along the second guide section 582 from one end of the first guide section 581 and a protrusion 552 which protrudes toward an inside of the support part 50 from one end of the extension 551.

The extension 551 may be made of a material having high elasticity and the protrusion 552 may be provided with, for example, an inclined surface gradually inclined inwardly in a direction of the rotating protrusion receiving groove 54 from the second guide section 582 but is not limited thereto.

By the above construction, the pair of anti-separation parts 55 may snap-fit connect the pair of rotating protrusions 44 guided through the first and second guide sections 581 and 582 with the pair of rotating protrusion receiving grooves 54. The extension 531 and the protrusion 552 may be elastically changed to the inside and the outside of the support part 50 through the cut-away groove 553 which is formed to have at least three surfaces cut on the pair of rotating protrusion guide grooves 54 when the extension 531 and the protrusion 552 are snap-fit connected with each other, and therefore may be elastically changed to the outside of the support part 50 by the pair of rotating protrusions 44 pressing an inclined surface 552*a*. Next, when the pair of rotating protrusions 44 is received in the pair of rotating protrusion receiving grooves 54, the extension 531 and the protrusion 552 are elastically recovered to an original position.

Therefore, the pair of anti-separation parts 55 may prevent the pair of rotating protrusions 44 of the second shelf from being separated forward with respect to the support part 50 and even when the user applies a force upward and forward with respect to the variable shelf apparatus 23 due to the withdrawal of things in the refrigerator to the outside, etc., the variable shelf apparatus 23 is prevented from being separated forward from the pair of rotating protrusion receiving grooves 54.

Meanwhile, a rotating sliding protrusion 57 may be formed around the pair of rotating protrusion receiving grooves 54. The detailed description thereof will be described below.

Figure 10:
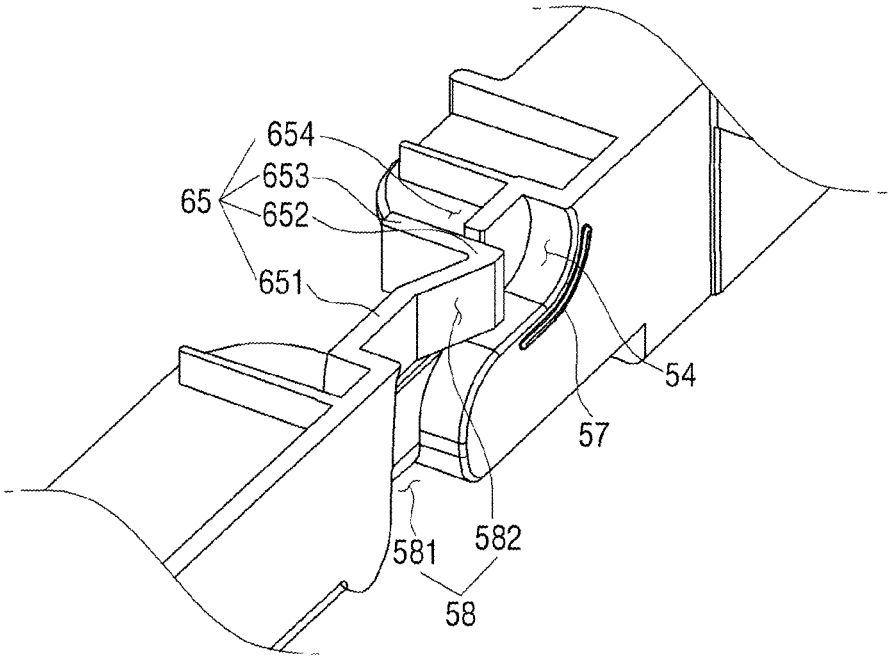
FIG. 10 is a partial cut-away view illustrating another example of the rotating protrusion receiving groove, the rotating protrusion guide groove, and the anti-separation part.
Figure 11:
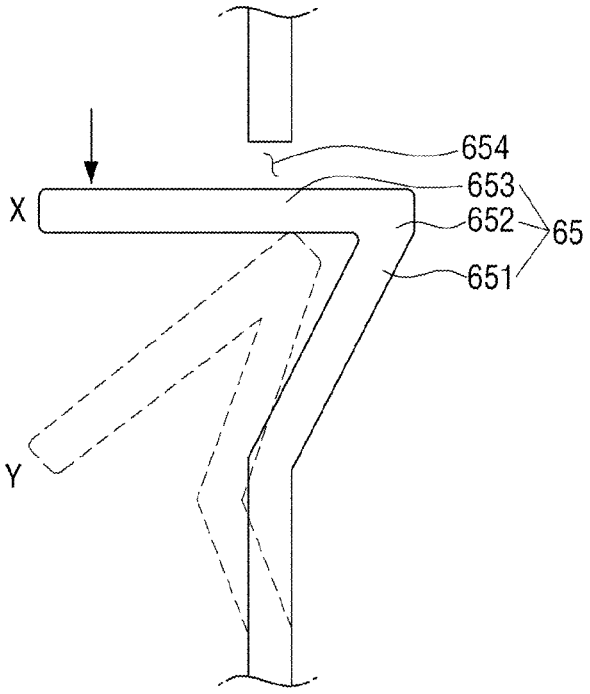
FIG. 11 is a cross-sectional view for describing an operation of the anti-separation part illustrated in FIG. 10.

FIG. 10 is a partial cut-away view illustrating another example of the rotating protrusion receiving groove 54, the rotating protrusion guide groove 58, and the anti-separation part 55 and FIG. 11 is a cross-sectional view for describing the operation of the anti-separation part 55 illustrated in FIG. 10.

Referring to FIGS. 10 and 11, the pair of anti-separation parts 55 may further include a releasing part 653 which extends to the outside of the support part 50 from one end of the protrusion 552 to separate the pair of rotating protrusions 44 from the rotating protrusion receiving groove 54. When the releasing part 653 is pressed in an arrow direction (see FIG. 11) by the user, an extension 651 and the protrusion 552 of the pair of anti-separation parts 65 move from position X to position Y through the cut-away groove 553. Therefore, the pair of rotating protrusions 44 which is otherwise prevented from being separated forward by the protrusion 652 may be separated from the pair of rotating protrusion receiving grooves 54 and thus the receiving of the pair of rotating protrusions 44 may be released.

Figure 12:
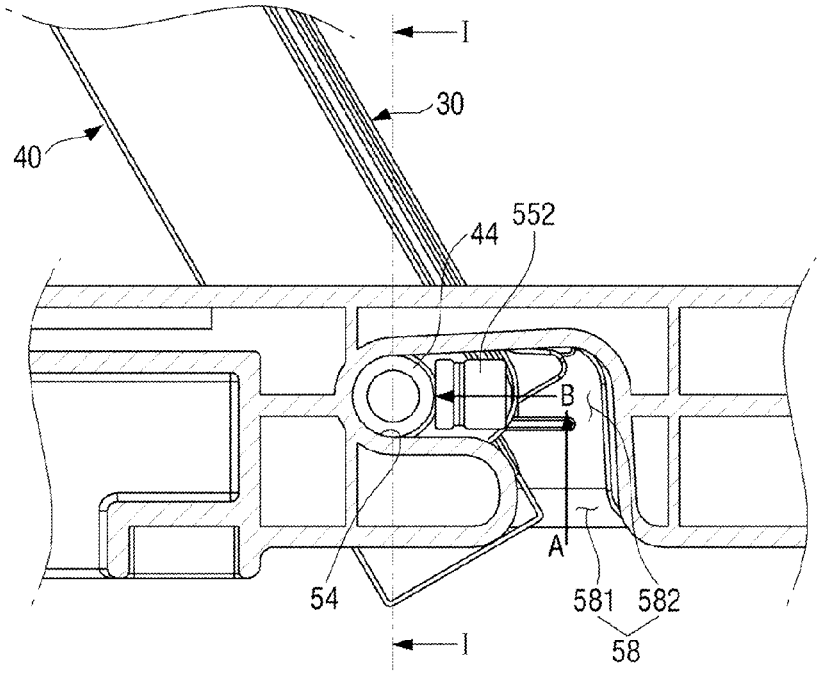
FIG. 12 is a cross-sectional view illustrating a state in which the first and second shelves illustrated in FIG. 2 rotate up while being supported by the support part.

FIG. 12 is a cross-sectional view illustrating a state in which the first and second shelves illustrated in FIG. 2 rotate up while being supported by the support part 50.

Referring to FIG. 12, the pair of rotating protrusions 44 of the second shelf part 40 may be moved along arrows A and B and thus may be received in the pair of rotating protrusion receiving grooves 54. Next, the second shelf part 40 rotates up based on the pair of rotating protrusions 44 while being coupled with the first shelf part 30 and thus the upper surface 50*a* of the second shelf part 40 may face the rear wall of the refrigerator compartment 12. In this case, the upper surface of the rotating second shelf part 40 may be supported by a edge 512*a* (see FIGS. 2 and 5) inside the rear support frame 512 of the support part 50. In this case, the rotating second shelf part 40 is not spaced apart from the rear support frame 512 of the support part 50 at a predetermined distance, such that a space for storing tall food may be more secured.

Figure 13:
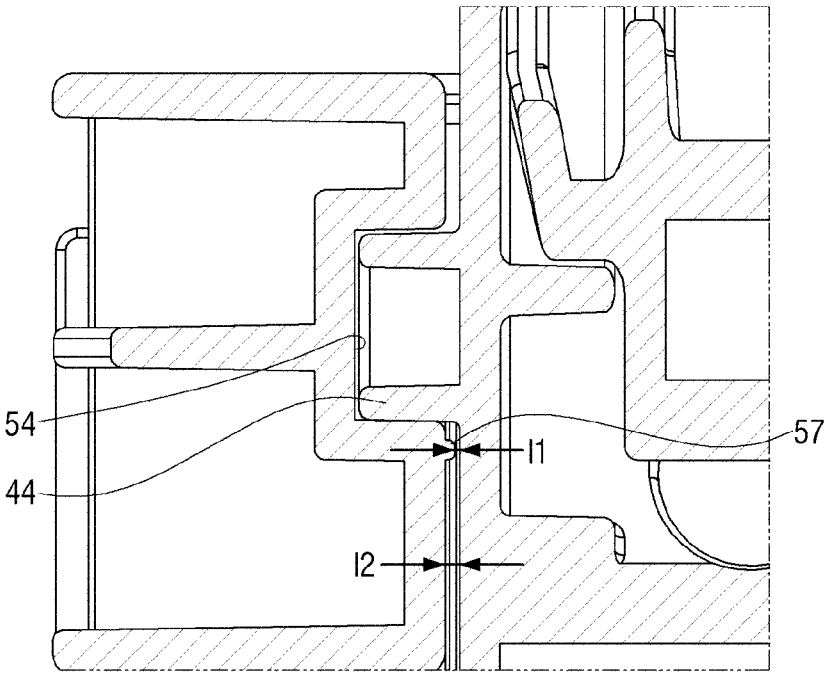
FIG. 13 is a cross-sectional view of the line I-I illustrated in FIG. 12.

FIG. 13 is a cross-sectional view of the line I-I illustrated in FIG. 12.

Referring to FIG. 13, the rotating sliding protrusion 57 is formed around the pair of rotating protrusion receiving grooves, such that the outside of the second shelf part 40 and the inside of the side support frame 511 do not face-contact each other but line-contact each other. Therefore, the rotating operability of the second shelf part 40 depending on the rotating sliding protrusion 57 may be enhanced.

Meanwhile, the rotating sliding protrusion 57 supports the outside of the second shelf part 40 to reduce an assembling gap from approximately 0.75 mm (12) to approximately 0.25 mm (11). Therefore, the rotating sliding protrusion 57 reduces the left and right movement of the second shelf part 40 while enhancing left and right centering of the second shelf part 40 for the support part 50, thereby reducing noise.

Next, the operation of the variable shelf apparatus 23 used in the refrigerator according to the exemplary embodiment of the present disclosure configured as described above will be described.

First, to store a plurality of short stored goods as illustrated in FIG. 14A at ordinary times, the state in which both of the rear space and the front space of the refrigerator compartment 12 are partitioned by the first and second shelf parts 40 needs to be maintained.

In this case, in the first shelf part 30, the front frame 32 is seated in one end of the front of the upper guide part 52, the protrusion receiving groove part 341 is seated in the anti-sliding protrusion 56, and the height adjustment protrusion 35 is supported to the rear end of the lower guide part 53. In the second shelf part 40, the front end 431*a* of the first skirt part 431 is seated in the seating part 59 and the pair of rotating protrusions 44 is received in the pair of rotating protrusion receiving grooves 54.

When there is a need to store tall stored goods, as illustrated in FIG. 14B, the user lifts the first shelf part 30 up and then pushes the first shelf part 30 backward and thus the protrusion receiving groove part 341 of the first shelf part is separated from the anti-sliding protrusion 56. Further, the first shelf part 30 is guided to the lower portion of the second shelf part 40 through the guide rib 34 guided by the upper guide part 52 and is likewise guided to the lower portion of the second shelf through a second lower end of the first shelf part 30 guided by the lower guide part 53. By the above operation, the first shelf part 30 is coupled with the lower portion of the second shelf part 40 in the state in which the first shelf part 30 overlaps the second shelf part 40. Therefore, the front space of the refrigerator compartment 12 which is partitioned by the first shelf part 30 is open and thus the tall stored foods may be stored in the space which is partitioned by the first shelf part 30.

Further, when the height is higher than the interval between the variable shelf apparatuses 23 and the width of the front and rear directions thereof needs to store the stored goods wider than the space which is partitioned by the first shelf part 30, if as illustrated in FIG. 14C, the second shelf part 40 rotates upward based on the pair of rotating protrusions 44 of the second shelf part 40 by applying a force to the second shelf part 40 in the state in which the first shelf part 30 overlaps the second shelf part 40 to have the upper surface of the second shelf part 40 face the rear wall of the refrigerator compartment 12, such that the rear space of the refrigerator compartment 12 which is partitioned by the second shelf part 40 is open. Therefore, both of the front space of the refrigerator compartment 12 which is partitioned by the first shelf part 30 and the rear space of the refrigerator compartment 12 which is partitioned by the second shelf part 40 are open up and down, and therefore the stored goods of which the height is higher than the interval between the variable shelf apparatuses 23 and the width in the front and rear directions is larger than the front space taken up by the first shelf part 30 may be stored in the refrigerator compartment 12.

Meanwhile, to separate the first and second shelf parts 30 and 40 from the support part 50 after the support part 50 is drawn from the refrigerator compartment, as described above, a method for pressing the releasing part 653 of the anti-separation part 55, and the like may be used.

According to the exemplary embodiment of the present disclosure, the support part 50 is formed as a separate member from the refrigerator compartment and thus is separably installed in the refrigerator compartment 12, but the exemplary embodiment of the present disclosure is not limited thereto and the support part 50 may be integrally formed inside the refrigerator compartment 12 of the refrigerator.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, such modifications, additions and substitutions should also be understood to fall within the scope of the present disclosure.

What is claimed is:

1. A variable shelf apparatus comprising:

a first shelf part;

a second shelf part configured to slidably couple with the first shelf part and comprising a pair of rotating protrusions protruding at both sides of the second shelf part; and a support part configured to:

support the first shelf part to slide along the support part, and support the second shelf part to rotate while being coupled with the pair of rotating protrusions, wherein the support part includes:

an upper surface, a lower surface, first guide sections extending from the lower surface toward the upper surface, second guide sections, and a pair of rotating protrusion receiving grooves formed in between the upper surface and the lower surface, the pair of rotating protrusion receiving grooves selectively coupled with and separated from the pair of rotating protrusions, the pair of rotating protrusions prevented from being separated from the support part when a force is applied upward with respect to the variable shelf apparatus while the rotating protrusions are coupled with the rotating protrusions receiving grooves; and wherein each second guide section connects one of the first guide sections to one of the rotating protrusion receiving grooves.

2. The variable shelf apparatus as claimed in claim 1, wherein the support part further comprises:

a pair of rotating protrusion guide grooves comprising the first guide sections and the second guide sections, the rotating protrusion guide grooves configured to guide the pair of rotating protrusions to the pair of rotating protrusion receiving grooves from the lower surface of the support part; and a pair of anti-separation parts elastically disposed on the pair of rotating protrusion guide grooves so that the pair of rotating protrusions are selectively coupled with and separated from the pair of rotating protrusion receiving grooves, the anti-separation parts configured to prevent the pair of rotating protrusions from being separated forward with respect to the support part when a force is applied forward with respect to the variable shelf apparatus.

3. The variable shelf apparatus as claimed in claim 2, wherein the second guide section is formed in parallel with the upper surface of the support part.

4. The variable shelf apparatus as claimed in claim 2, wherein the pair of anti-separation parts are formed to have at least three surfaces cut on the pair of rotating protrusion guide grooves so as to have an elastic force in an inside and an outside direction of the support part.

5. The variable shelf apparatus as claimed in claim 4, wherein the pair of anti-separation parts includes:

an extension configured to extend along the second guide section from the end of the first guide section; and a protrusion configured to protrude toward an inside of the support part at an end of the extension.

6. The variable shelf apparatus as claimed in claim 5, wherein the protrusion is provided with an inclined surface gradually inclined inward in a direction of the rotating protrusion receiving groove from the second guide section.

7. The variable shelf apparatus as claimed in claim 4, wherein the pair of anti-separation parts further comprises a releasing part that extends to an outside of the support part from an end of a protrusion to separate the rotating protrusion from the rotating protrusion receiving groove.

8. The variable shelf apparatus as claimed in claim 1, wherein the support part includes:

a first shelf receiving part configured to receive the first shelf part;

a second shelf receiving part configured to be extendedly formed in the first shelf receiving part and to receive the second shelf part; and a guide part configured to be formed along an inside of the first shelf receiving part to guide the first shelf part to the second shelf receiving part.

9. The variable shelf apparatus as claimed in claim 8, wherein the guide part comprises an upper guide part and a lower guide part, which support an upper end and a lower end of the first shelf part.

10. The variable shelf apparatus as claimed in claim 9, wherein the upper guide part and the lower guide part each comprise inclined surfaces so that a first shelf surface and a second shelf surface are disposed on a same plane in a state in which the first shelf part is drawn forward from the second shelf part.

11. The variable shelf apparatus as claimed in claim 9, wherein the upper guide part includes an anti-sliding protrusion formed at a front end of the upper guide part so that the first shelf part is seated with the upper guide part to prevent the first shelf part from being slid in a forward direction or a backward direction.

12. The variable shelf apparatus as claimed in claim 11, wherein an outside of the first shelf part is provided with a guide rib extending forward and backward so that the first shelf part is guided while being supported by the upper guide part.

13. The variable shelf apparatus as claimed in claim 12, wherein the guide rib comprises a protrusion receiving groove receiving the anti-sliding protrusion.

14. The variable shelf apparatus as claimed in claim 9, wherein a rear end of the first shelf part further comprises a height adjustment protrusion protruding downward to adjust a height of the rear end of the first shelf part while the height adjustment protrusion interfering with a rear end of the lower guide part.

15. The variable shelf apparatus as claimed in claim 14, wherein a front surface of the height adjustment protrusion is inclined.

16. The variable shelf apparatus as claimed in claim 1, wherein the second shelf part is provided with a sliding groove extending forward and backward to guide the first shelf part to a first shelf receiving part so as to support the first shelf part.

17. The variable shelf apparatus as claimed in claim 16, wherein the support part further comprises a seating part in which a front end of the second shelf part is seated.

18. A refrigerator, comprising:

a storage room to store food items;

a main body including an inner case forming the storage room and an outer case forming an appearance of the refrigerator; and a variable shelf apparatus comprising:

a first shelf part;

a second shelf part configured to slidably couple with the first shelf part and comprising a pair of rotating protrusions protruding at both sides of the second shelf part; and a support part configured to be installed in the storage room to support the first shelf part to slide along the support part, and support the second shelf part to rotate while being coupled with the pair of rotating protrusions, wherein the support part includes:

an upper surface;

a lower surface;

a pair of rotating protrusion receiving grooves formed in between the upper surface and the lower surface to be coupled with the pair of rotating protrusions to prevent the pair of rotating protrusions from being separated from the support part when a force is applied upward with respect to the variable shelf apparatus while the pair of rotating protrusions are coupled with the pair of rotating protrusion receiving grooves;

a pair of rotating protrusion guide grooves, the rotating protrusion guide grooves each comprising a first guide section and a second guide section, each first guide section extending from the lower surface towards the upper surface to guide the pair of rotating protrusions from the lower surface of the support part toward the upper surface, each second guide section connecting one of the first guide sections to one of the pair of rotating protrusion receiving grooves; and a pair of anti-separation parts elastically disposed on the pair of rotating protrusion guide grooves so that the pair of rotating protrusions are selectively coupled with and separated from the pair of rotating protrusion receiving grooves, and the anti-separation parts prevent the pair of rotating protrusions from being separated forward from the rotating protrusion receiving grooves when a force is applied forward with respect to the variable shelf apparatus.

* * * * *